US007114192B1

(12) United States Patent
Prouty

(10) Patent No.: US 7,114,192 B1
(45) **Date of Patent: *Oct. 3, 2006**

(54) TWO SIDED WORK GLOVE

(76) Inventor: Ronald L. Prouty, 239 NE. Graham, Portland, OR (US) 97212

( * ) Notice: Subject to any disclaimer, the term of this patent is extended or adjusted under 35 U.S.C. 154(b) by 185 days.

This patent is subject to a terminal disclaimer.

(21) Appl. No.: 10/629,282

(22) Filed: Jul. 29, 2003

(51) Int. Cl.
*A41D 19/00* (2006.01)

(52) U.S. Cl. ..... 2/161.6; 2/163

(58) Field of Classification Search ..... 2/161.6, 2/163, 169

See application file for complete search history.

(56) References Cited

U.S. PATENT DOCUMENTS 2,617,109 A * 11/1952 Slimovitz ..... 2/163
3,151,334 A * 10/1964 Haupt et al. ..... 2/169
4,894,866 A 1/1990 Walker
5,664,260 A 9/1997 Weiser
5,697,104 A 12/1997 Welton
6,298,490 B1 * 10/2001 Prouty ..... 2/161.6

* cited by examiner

*Primary Examiner*—Katherine M. Moran
(74) *Attorney, Agent, or Firm*—Mark S Hubert

(57) ABSTRACT

A two sided work glove assembled by the stitched union of several patterned pieces including a thumb enclosure piece or pieces, a middle fingers piece and a palm portion. The glove may include a cuff. The glove is easily adapted for different specific uses by the addition of an external or internal pad or an internal liner. The glove stitching is protected by protective overhanging strips incorporated between the palm portion and the finger and thumb enclosures.

2 Claims, 13 Drawing Sheets

26
27
8
28
29

20
24
22
18
2
16

6

4

10
12

FIG. 8
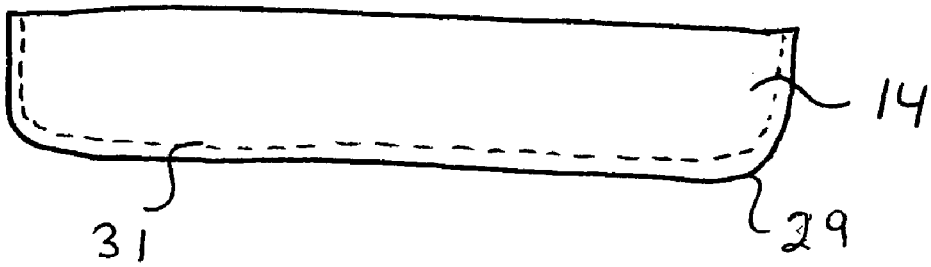
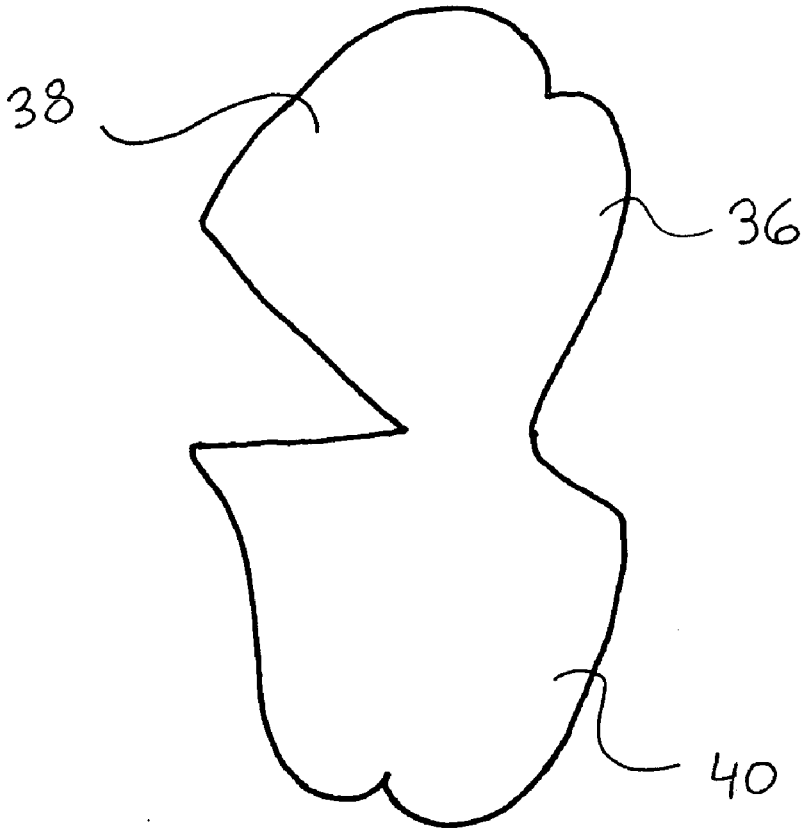
FIG. 14

FIG. 27
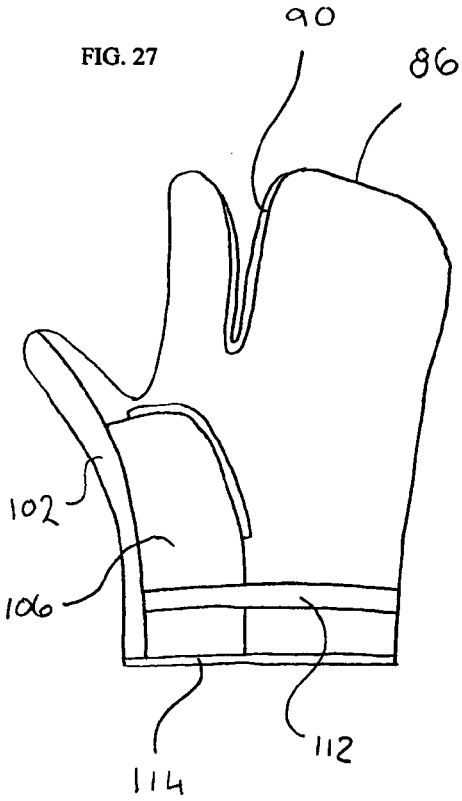
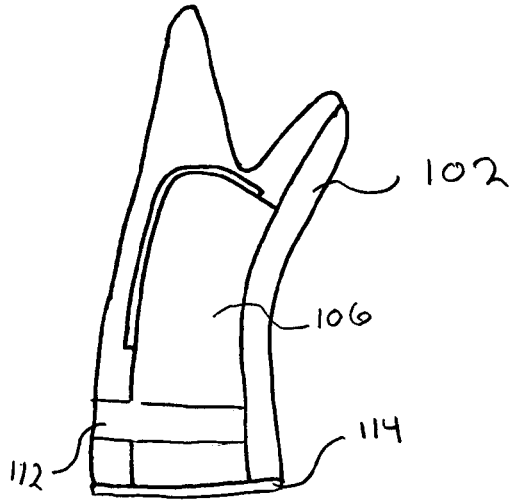
FIG. 29
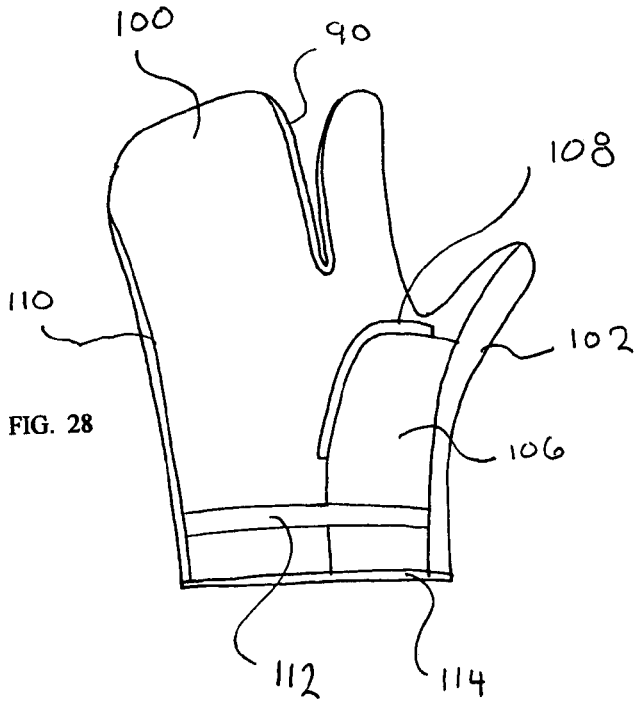
FIG. 28

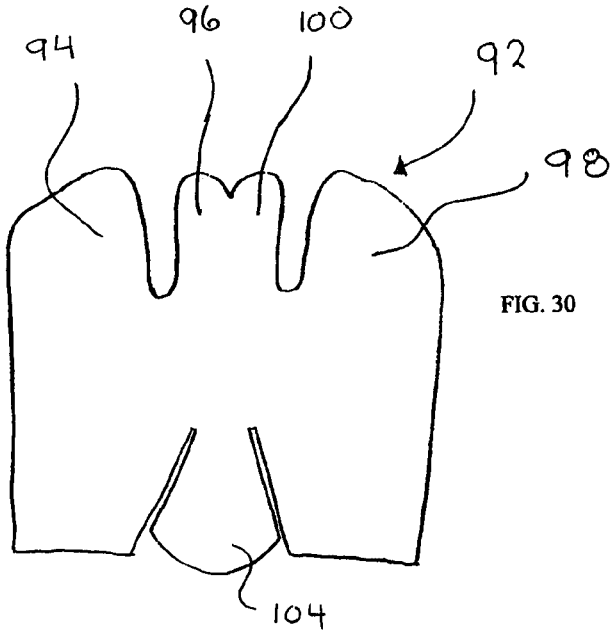
FIG. 30
FIG. 32
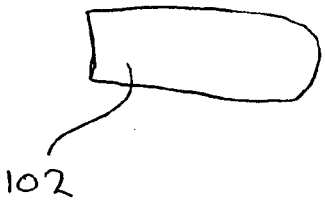
FIG. 31
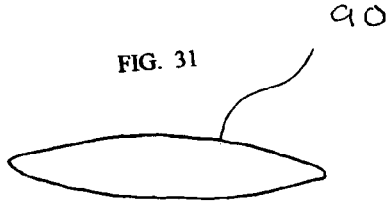
FIG. 34
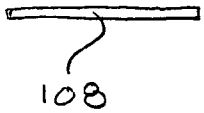
FIG. 33
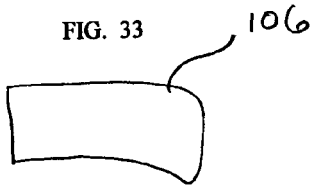
FIG. 35
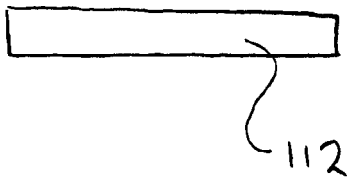

TWO SIDED WORK GLOVE

BACKGROUND OF THE INVENTION

The present invention relates to a work glove and primarily to a work glove used by workers handling abrasive materials, materials with sharp edges, materials at extreme temperatures or prone to shedding slivers when handled.

Gloves can only be made from materials within a limited range of thickness. Exceeding this, the flexibility of the glove will hamper the worker's ability to efficiently perform his job. As such, gloves wear out. It is rare that both the gloves worn on the right and left hands wear out at the same time, however, since gloves are purchased in pairs, it is normal to replace both at the same time. The present invention is a glove that can be worn on either hand. Both the front side and the back side of the glove are suited for work with abrasive materials. In theory, the worker "rotates" or alternates the two sided gloves between his two hands so that they wear uniformly. This, along with the incorporation of "stitching savers" increases glove life.

Although there are numerous two sided work gloves known in the prior art, They differ in the number and configuration of the pieces sewn together to create the glove. It is this specific combination of pieces and pattern configurations that give each glove its own distinct "feel". It is this "feel" (based primarily on the glove's flexibility) that sells gloves.

This new glove utilizes a specific combination of pieces and pattern configurations that contribute to an overall "good feel".

SUMMARY OF THE INVENTION

In accordance with the invention, an object of the present invention is to provide an improved two sided work glove with stitching savers to lengthen the wear life of the glove.

It is another object of this invention to provide a work glove of an efficient physical pattern and pattern pieces so as to enable simple, efficient stitch assembly.

It is a further object of this invention to provide a work glove that is sewn together and assembled inside out such that the stitching is concealed and the glove can be tailored for different applications by the simple addition of additional padding or lining which is sewn to the inside of the glove.

It is still a further object of this invention to provide a work glove of an ergonomic patterned design so as to increase the overall finger, thumb and palm flexibility of the glove, regardless of which hand it is worn on.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 8 is a plan view of the cuff;

FIG. 14 is a plan view of the middle fingers piece for the first alternate embodiment work glove;

FIG. 27 is plan view of a first side of the single finger two sided work mitt;

FIG. 28 is plan view of a second side of the single finger two sided work mitt;

FIG. 29 is plan side view of the single finger two sided work mitt;

FIG. 30 is a plan view of the palm mitt piece for the single finger two sided work mitt;

FIG. 31 is a plan view of the finger side for the single finger two sided work mitt;

FIG. 32 is a plan view of the back thumb piece for the single finger two sided work mitt;

FIG. 33 is plan view of the thumb side piece for the single finger two sided work mitt;

FIG. 34 is plan view of the thread saver for the single finger two sided work mitt;

FIG. 35 is a plan view of the hem trim piece for the single finger two sided work mitt.

DETAILED DESCRIPTION

Figure 1:
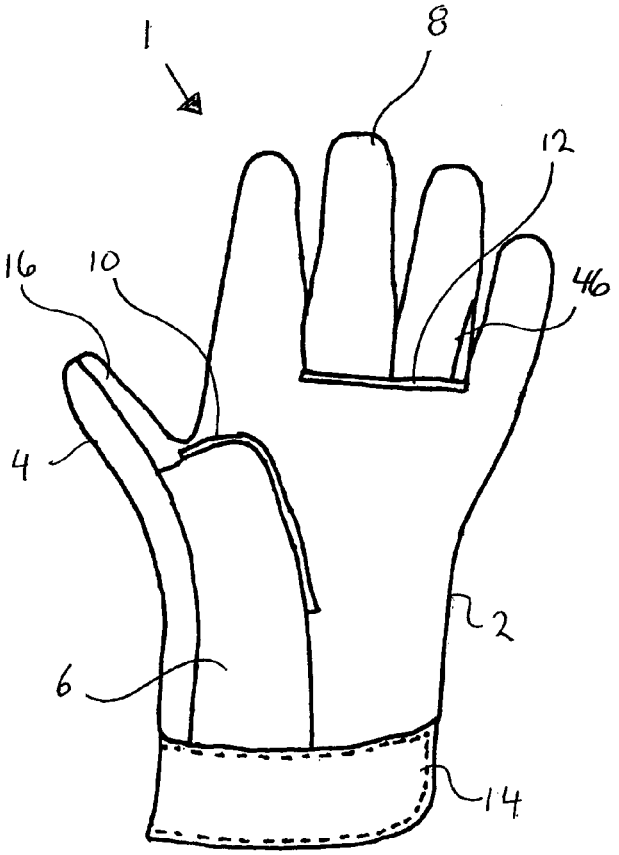
FIG. 1 is a front plan view of the preferred embodiment work glove.

The preferred embodiment of the two sided work glove 1 comprises a palm piece 2, an outer thumb piece 4, two thumb side pieces 6, a middle fingers piece 8, short thread saver strip 10, long thread saver strip 12 and cuff 14. The pattern and stitched assembly of the various pieces allow for a comfortable and natural palmar and digit flexion of either of the wearer's hands.

The material of construction will vary with the desired application. Leather, cotton, vinyl, rubber, nylon, and Kevlar® are commonly used materials in the industry, however this is not an exhaustive list. Similarly, the thread used in stitching is that of those commonly used in the industry and may be nylon, cotton, polyester, Kevlar® thread or a blend of thereof. Both the material of construction and the stitching thread may be impregnated or coated with property specific substances such as fire resistors, waterproofers or corrosion resistors. The alternate embodiments offer various configurations of patterned pieces to replace some of the preferred embodiment's patterned pieces or additional pieces designed to enable the glove for a specific purpose. Note, since this glove is two sided, there are not mirror image right and left hand gloves. The right and left hand glove is the same glove. As such only one glove is shown for each of the various embodiments.

The advantages of this invention as applied to use may not be apparently visible but rather reside in the ability for the glove to be hand sewn in an efficient manner in an inside out configuration. Such economy of physical manipulation is greatly appreciated in this field of art where commonly much or all of the assembly is performed manually in foreign countries. This is best understood in reference to the sewing directions.

Figure 2:
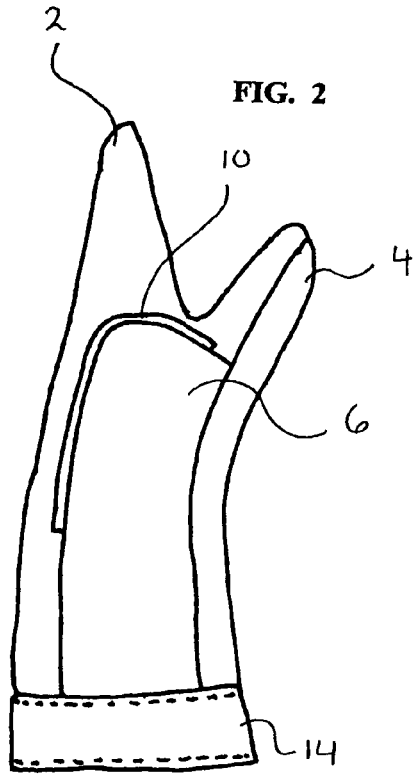
FIG. 2 is a side plan view of the preferred embodiment work glove.

Referring to FIGS. 1 and 2, a front and side plan view of preferred embodiment work glove 1, it can be seen that inner thumb section 16 of palm piece 2 has been stitched to outer thumb piece 4. Thumb sides 6 have been stitched to outer thumb piece 4 and palm piece 2 so as to form a thumb pocket. Long thread saver strip 12 is sandwiched between the stitching surfaces of thumb side piece 6 and palm piece 2. Middle fingers piece 8 and palm piece 2 have been sewn together so as to form the index, second, third and last finger pockets. Short thread saver strip 10 is sandwiched between the stitching surfaces of middle fingers piece 8 and palm piece 2. Cuff 14 is sewn to palm piece 2. Note, that the preferred embodiment has sewing seam 46 on the third finger, visible from the front palm side of the hand with the thumb on the left. This configuration allows for a more natural flex of the fingers while wearing the glove.

Figures 3, 4, 5, 6, 7:
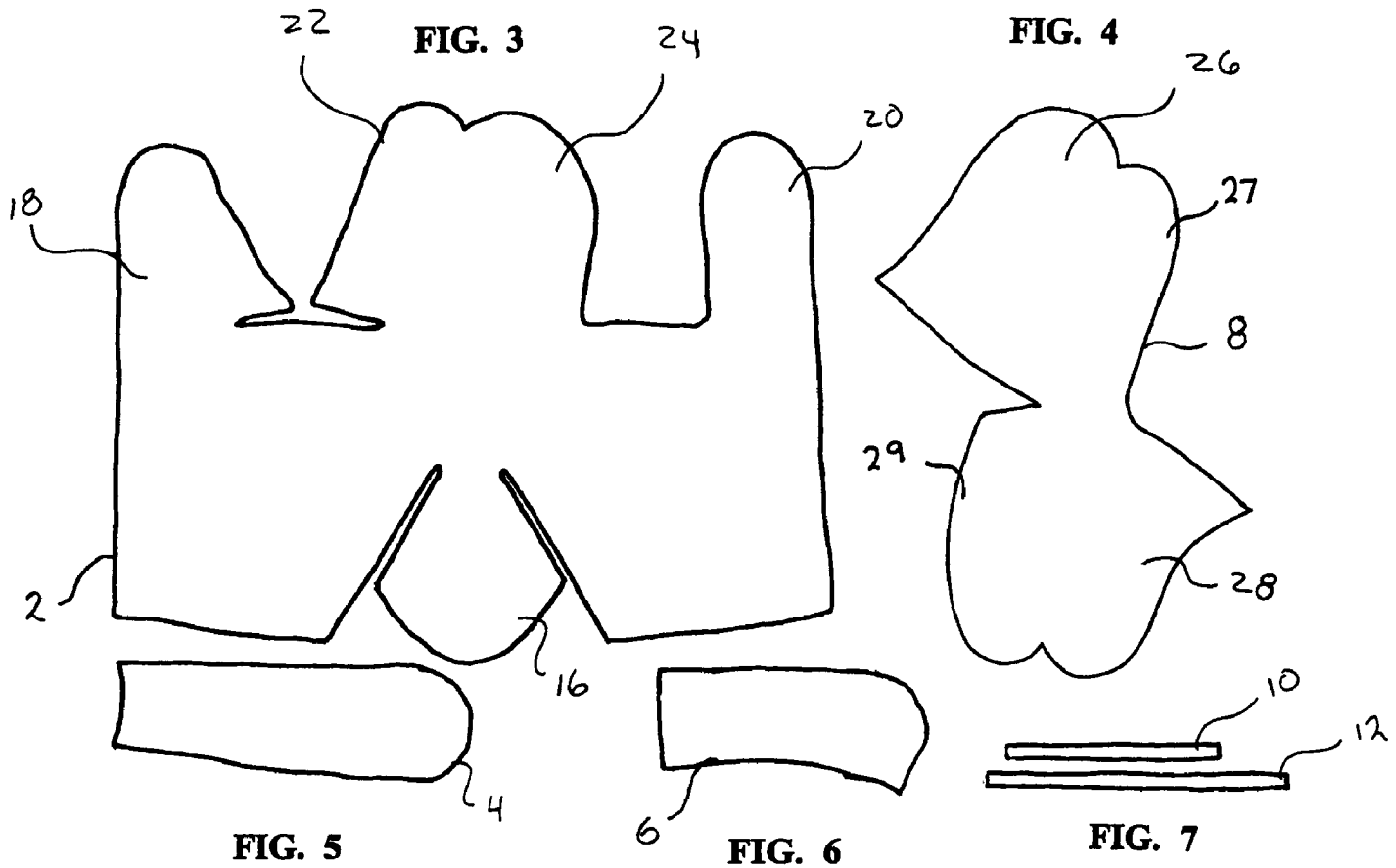
FIG. 3 is a plan view of the palm piece for all embodiments of the work glove.
FIG. 4 is a plan view of the middle fingers piece for the preferred embodiment work glove.
FIG. 5 is a plan view of the thumb top piece.
FIG. 6 is a plan view of the thumb sides.
FIG. 7 is a plan view of the stitch savers.

FIG. 3 shows the pattern of palm piece 2. Fourth finger section A 18 and fourth finger section B 20 are stitched together as is index finger section A 22 and index finger section B 24. These form the index and fourth finger pockets. Inner thumb section 16 is clearly visible.

FIG. 4 shows the pattern of the preferred embodiment middle fingers piece 8. Second finger section A 26 and second finger section B 27 are stitched together to form the second finger pocket. Similarly, third finger section A 28 and third finger section B 29 are stitched to form the third finger pocket.

FIG. 5 shows the pattern of outer thumb piece 4.

FIG. 6 shows the pattern of thumb side pieces 6. There are two of these pieces utilized in the assembly of the preferred embodiment. Since in the preferred embodiment they are fabricated from leather, they are identical pieces but are sewn in the glove as mirror images of each other.

FIG. 7 shows the pattern of the thread saver strips 10 and 12. These strips vary only in their length. There are four of these strips utilized in the fabrication of the glove. Short thread saver strip 10 is sandwiched in the stitching between middle fingers piece 8 and palm piece 2. Long thread saver strip 12 is sandwiched in the stitching between side thumb pieces 6 and palm piece 2.

FIG. 8 shows the pattern of cuff 14 looking at the outside surface. The visible stitching 31 represents that the finished edge 29 is accomplished by rolling the jagged, unfinished edge of the cuff material back on itself and stitching it so as to create a smooth, reinforced finished edge 29 or hem. The material from which cuff 14 is fabricated may differ from that of the rest of the glove. It is chosen based upon the application of the glove.

At this juncture it is most illustrative and helpful to discuss the assembly of the preferred embodiment of the present invention by referring to FIGS. 9, 10, 11, 12 and 19.

Figure 19:
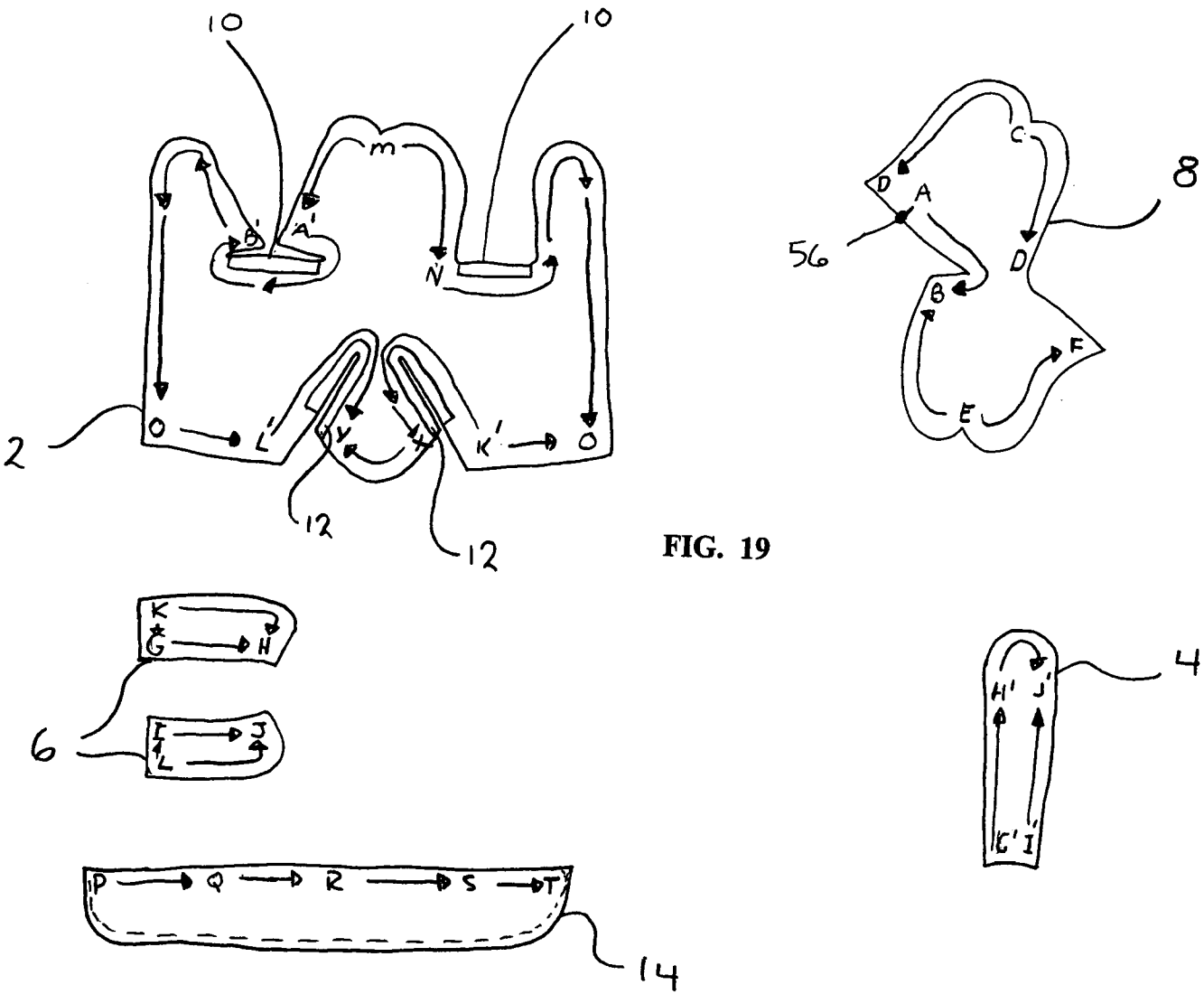
FIG. 19 is a plan view of the sewing pattern for the preferred embodiment work glove.
Figure 20:
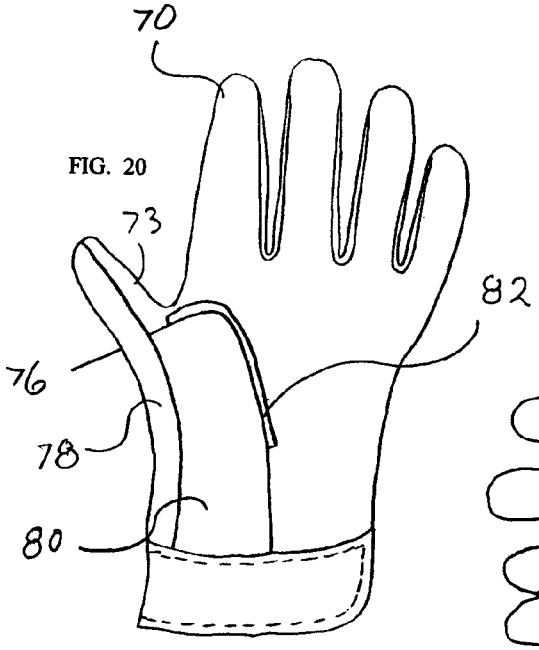
FIG. 20 is a front plan view of the third alternate embodiment work glove.
Figure 22:
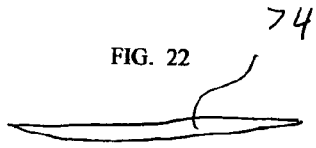
FIG. 22 is a plan view of a finger side for the third alternate embodiment work glove.
Figure 21:
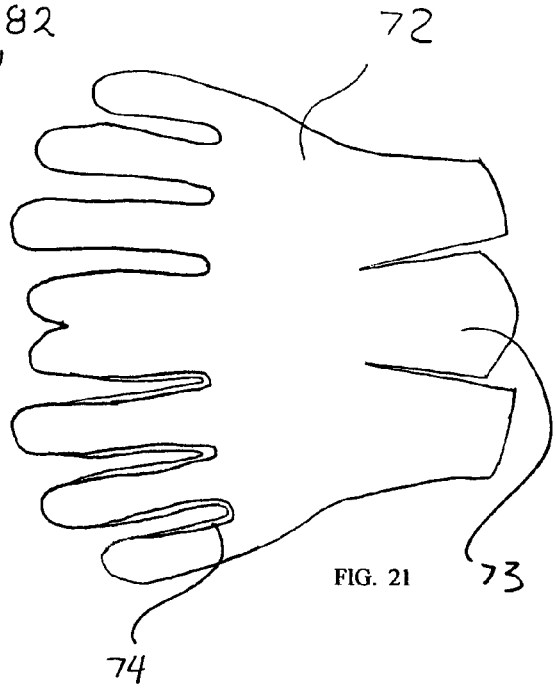
FIG. 21 is a plan view of the palm/finger piece of the third alternate embodiment work glove with finger sides attached.
Figure 25:
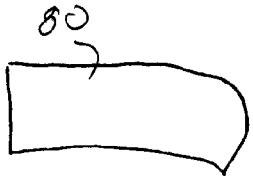
FIG. 25 is plan view of the thumb side piece for the third alternate embodiment work glove.
Figure 24:
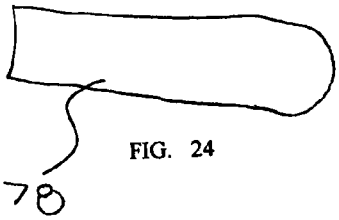
FIG. 24 is plan view of the back thumb piece for the third alternate embodiment work glove.
Figure 23:
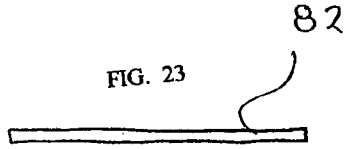
FIG. 23 is plan view of the thread saver for the third alternate embodiment work glove.
Figure 26:
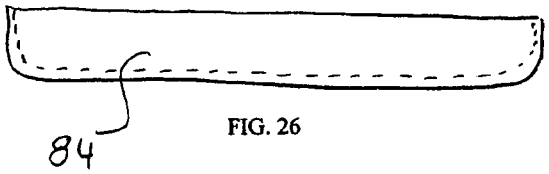
FIG. 26 is plan view of the cuff for the third alternate embodiment work glove.

FIG. 19, a plan view of the sewing pattern, must be understood through the following legend. Identical alphabetical letters on the same piece indicate that the piece is folded so that the two parts corresponding to that same letter have been overlapped and sewn together simultaneously. Letters and primed letters represent the same stitching lines but on different pieces to be sew assembled together. Arrows indicate the direction of sewing. Where no sewing direction is indicated, (as in the case of short thread saver strip 10 and long thread saver strip 12) the direction of sewing is not relevant. The first step is to sew the thread savers strips 10 and 12 onto palm piece 2 at the locations illustrated.

The sewing of the glove begins at starting points A 56 and A' 57 of palm piece 2 and middle fingers piece 8. Sewing proceeds from A to B. (Shown as A' to B' on the palm piece) Step two stitches C of middle fingers piece 8 to the two D's of the same middle fingers piece. (This step involves folding the piece over onto itself prior to sewing.) Step three stitches E of middle fingers piece 8 to B and F of the same middle fingers piece simultaneously. (This step involves folding the piece over onto itself prior to sewing.) Step three joins G and H of first thumb side piece 6 to G' and H' of outer thumb piece 4. Step four joins I and J of the second thumb side piece 6 to I' and J' of outer thumb piece 4. Step five joins K to H of first thumb side 6 to K' to X of palm piece 2. Similarly, step six joins L to J of second thumb side 6 to L' to Y of palm piece 2. Step seven joins H' to J' of outer thumb piece 4 to X to Y of palm piece 2. Step 8 joins M of palm piece 2 to A' and N of the same palm piece, simultaneously. (This step involves folding the piece over onto itself prior to sewing.) Step 8 sews N to O simultaneously with to B' to O. (This step involves folding the piece over onto itself prior to sewing.) The final step sews P to Q of cuff 14 to O to L' of palm piece 2, then Q to R of cuff 14 to K to G of first thumb side 6, then R to S of cuff 14 to L to I of second thumb side 6 and finally S to T of cuff 14 to K' to O of palm piece 2.

This assembly will leave the glove inside out. Liner 54, if desired, is sewn to the overhanging material that traces the outline of pattern of the glove's stitching, while the glove is still turned inside out.

Figure 9:
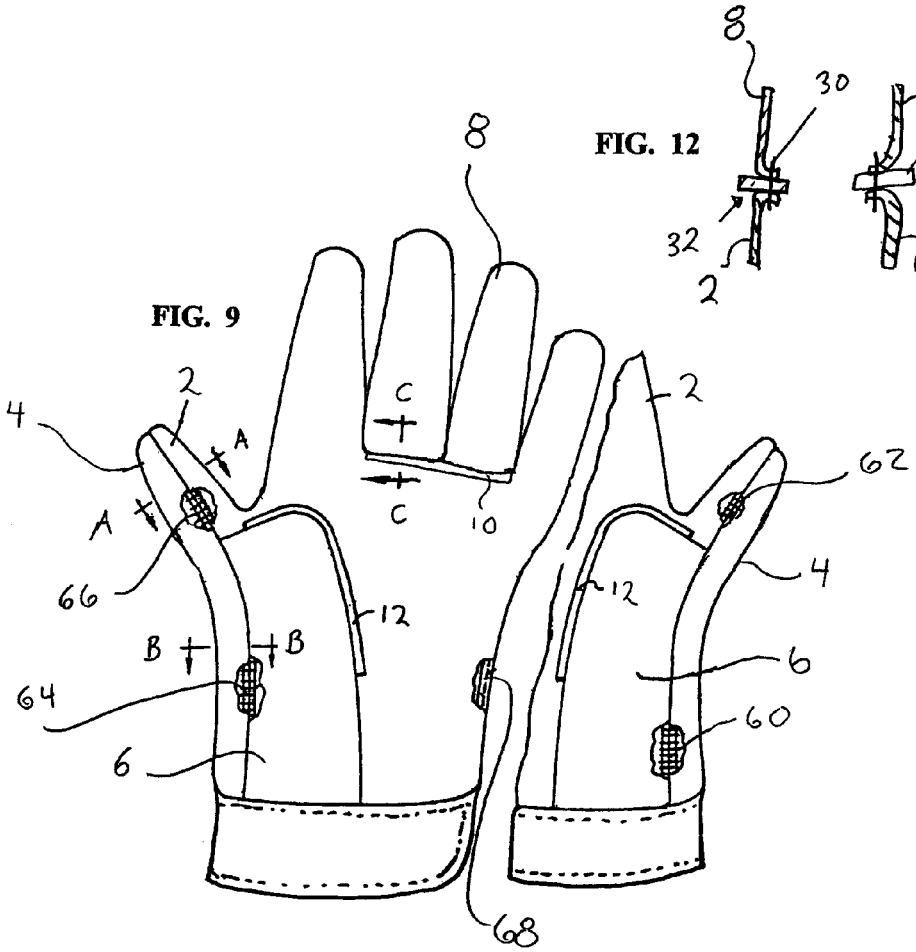
FIG. 9 is an cutaway view of the stitching details of the preferred embodiment work glove.
Figure 10:
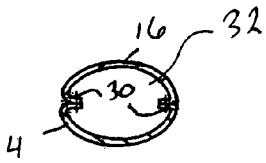
FIG. 10, is a cross sectional view of the thumb stitching details taken along line A—A of FIG. 9.
Figure 11:
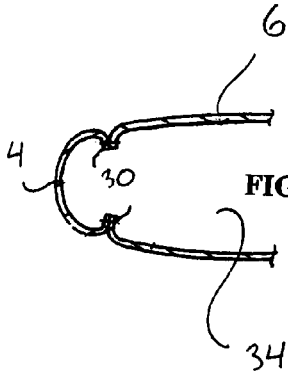
FIG. 11, is a cross sectional view of the thumb stitching details taken along line B—B of FIG. 9.

The internal sewing details can best be illustrated looking at FIGS. 9, 10, 11, and 12. Cutaway sections 60, 62, 64, 66, and 68 illustrate that all assembly sewing is done from the inside of the glove. The glove is assembled inside out so that when the glove is turned outside out after sewing assembly, the only glove stitching that is exposed is the visible stitching 31 of cuff 14 (described above). FIG. 10, a cross sectional view of the stitching details of the outer thumb piece 4 and inner thumb section 16 of palm piece 2 taken along line A—A of FIG. 9 shows that stitching thread 30 that joins outer thumb piece 4 and inner thumb section 16 of palm piece 2 is internal to thumb pocket 32. Similarly in FIG. 11, a cross sectional view of the stitching details of the joined outer thumb piece 4 and thumb sides 6 taken along line B—B of FIG. 9, it can be seen that the stitching thread 30 that joins outer thumb piece 4 to thumb sides 6 is internal to palm pocket 34.

Figure 12:
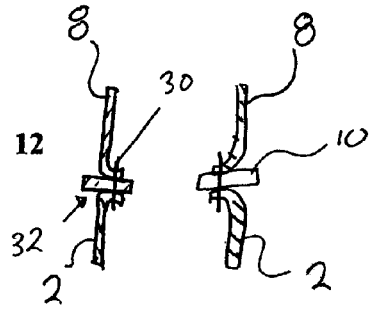
FIG. 12, is a cross sectional view of the sewing assembly of the middle fingers assembly and the thread savers taken along line C—C of FIG. 9.

FIG. 12, a cross sectional view of the stitching details of the middle fingers assembly taken along line C—C of FIG. 9 illustrates that short thread saver strip 10 is sandwiched between the stitching surfaces of middle fingers piece 8 and palm piece 2 so as to provide overhang 32. Overhang 32 acts to protect stitching thread 30 from contact with abrasive materials. This prolongs the life of stitching thread 30. In a sewing assembly fashion similar to that described of middle fingers piece 8 and palm piece 2, long thread saver strip 12 is sandwiched between palm piece 2 and thumb sides 6.

Figure 13:
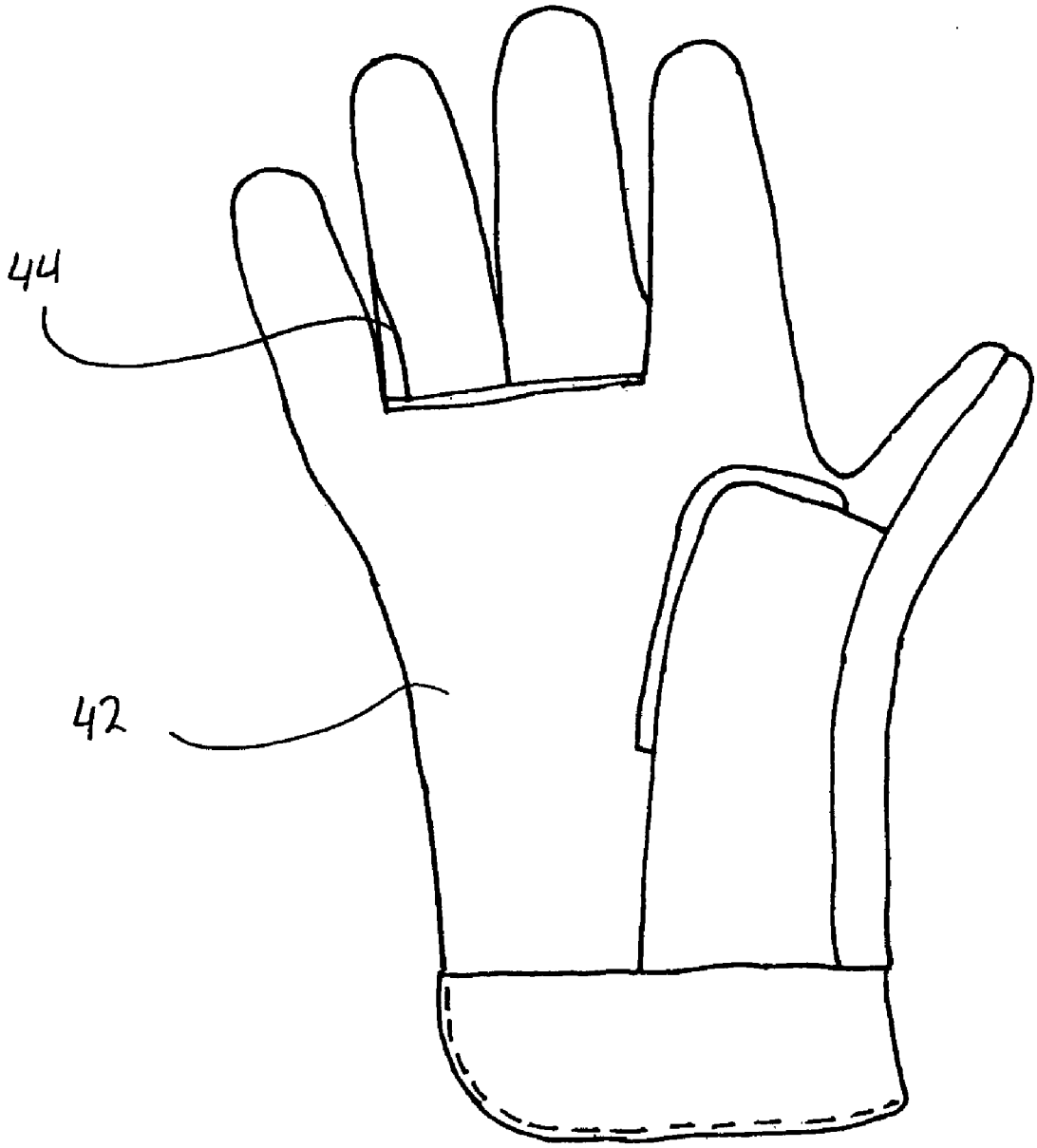
FIG. 13 is a plan view of the first alternate embodiment work glove.

FIG. 13, a plan view of first alternate embodiment glove 42, shows that sewing seam 44 resides on the third finger, palm side of the hand with the thumb on the right. This is accomplished when alternate embodiment middle fingers piece 36 is substituted for middle fingers piece 8 in the assembly of a glove. Although the sewing assembly of the alternate embodiment work glove is not identical to that of the preferred embodiment, it is so substantially similar that one skilled in the art, understanding the assembly of the preferred embodiment work glove, would easily facilitate the necessary changes. (The sewing directions do not differ, rather the starting point for the sewing changes as dictated by where alternate embodiment middle fingers piece 36 meets palm piece 2.)

FIG. 14 shows the pattern of the alternate embodiment middle fingers piece 36. Alternate embodiment second finger section 38 and alternate embodiment third finger section 40 are stitched to themselves so as to form the second and third finger pockets in a fashion similar to that used in middle fingers piece 8. When alternate embodiment middle fingers piece 36 is stitched together into a glove in conjunction with palm piece 2, outer thumb piece 4, two thumb side pieces 6, thread saver strips 10 and 12 and cuff 14, the resultant first alternate embodiment glove 42 is created.

Figure 15:
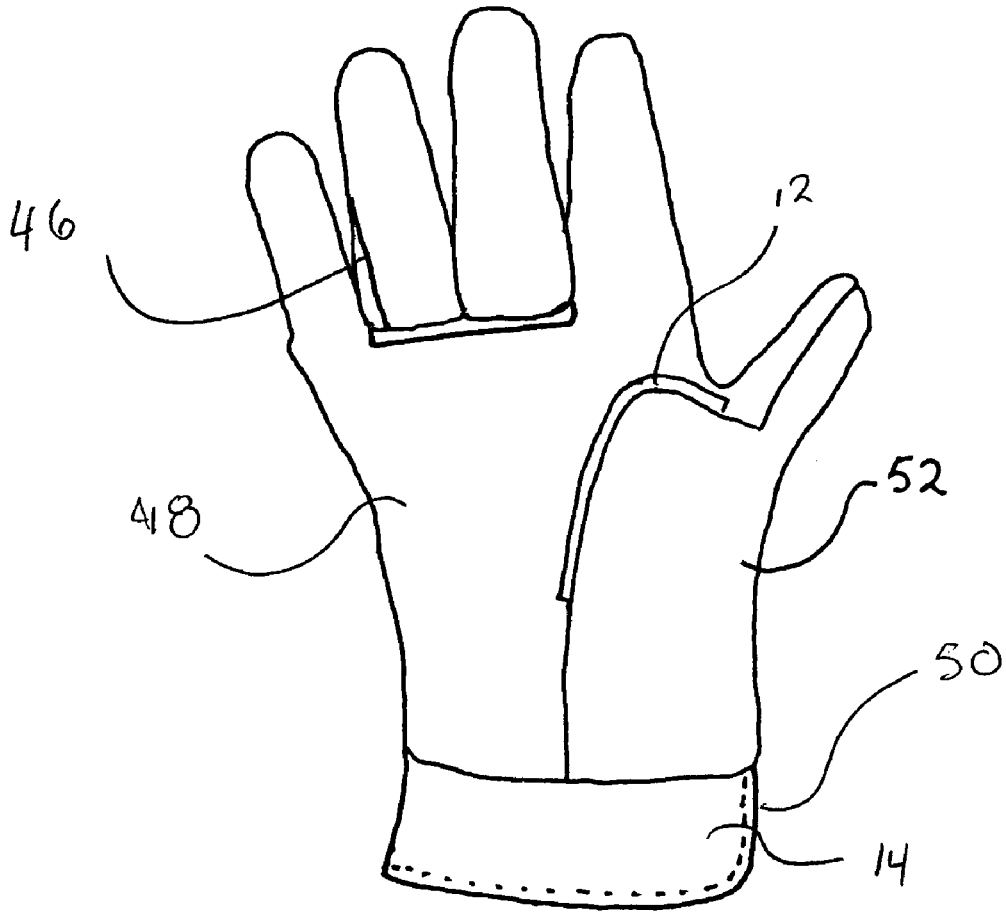
FIG. 15 is a front plan view of the second alternate embodiment work glove.

FIG. 15 shows second alternate embodiment work glove 48. It differs from the first alternate embodiment work glove 42 in two ways. First, cuff 14 has been rotated 180 degrees on the glove. This allows the open side 50 of the cuff 14 to be on the thumb side of the glove. (This concept of cuff rotation can be applied to the preferred embodiment glove 2 or the first alternate embodiment glove 42 as well.) Second, full thumb piece 52 is used in place of outer thumb piece 4 and the two thumb side pieces 6. Again, the sewing assembly of the second alternate embodiment work glove 48 is not identical to that of the preferred embodiment work glove 1 or the first alternate embodiment work glove 42, but it is so substantially similar that one skilled in the art, understanding the assembly of the preferred embodiment work glove, would easily facilitate the necessary changes.

Figure 16:
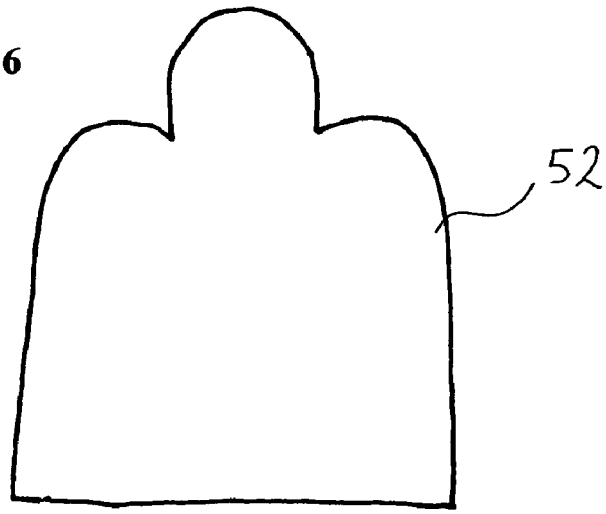
FIG. 16 is a plan view of the thumb piece for the second alternate embodiment work glove.

FIG. 16 shows full thumb piece 52 for the second alternate embodiment work glove.

Figure 17:
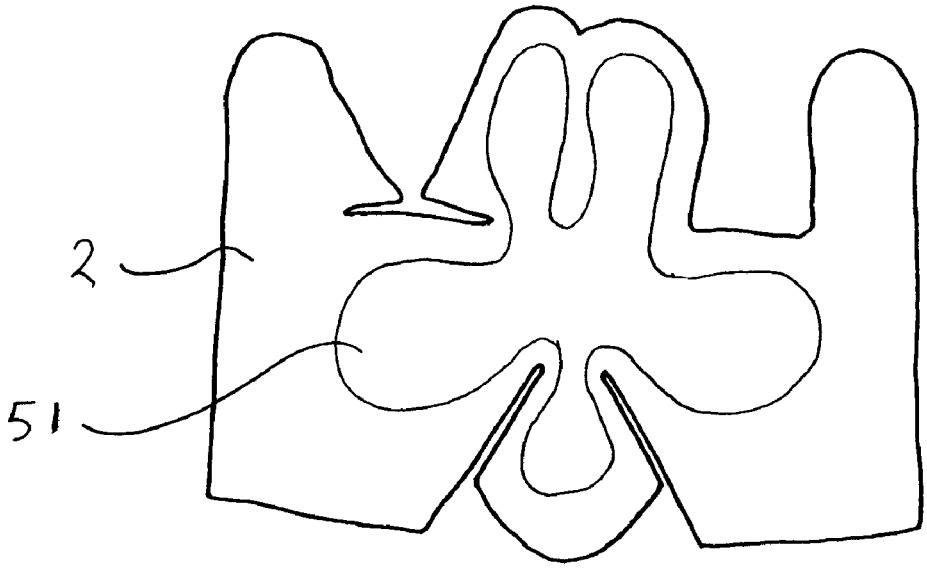
FIG. 17 is a plan view of the padding spider sewn to the palm piece.

FIG. 17, a plan view of the padding spider shows padding spider 51 sewn to palm piece 2. This is done well in advance of the glove's sewing assembly. Upon sewing assembly, padding spider 51 faces the inside of the glove. It functions to add extra padding to areas where the glove is prone to wear out. The thickness and the material of construction varies dependent upon the type and amount of protection sought. Leather, rubber, plastic, Kevlar® fabric, and cloth are typical materials. Although described as being sewn to the inside surface of palm piece 2 it may also be sewn to the outside surface, dependent upon the glove's purpose. It is also well known in the art that numerous variations of "guard" material may be mechanically attached to the exterior surface of a work glove to further the wear of the glove or to offer specific protection to the wearer.

Figure 18:
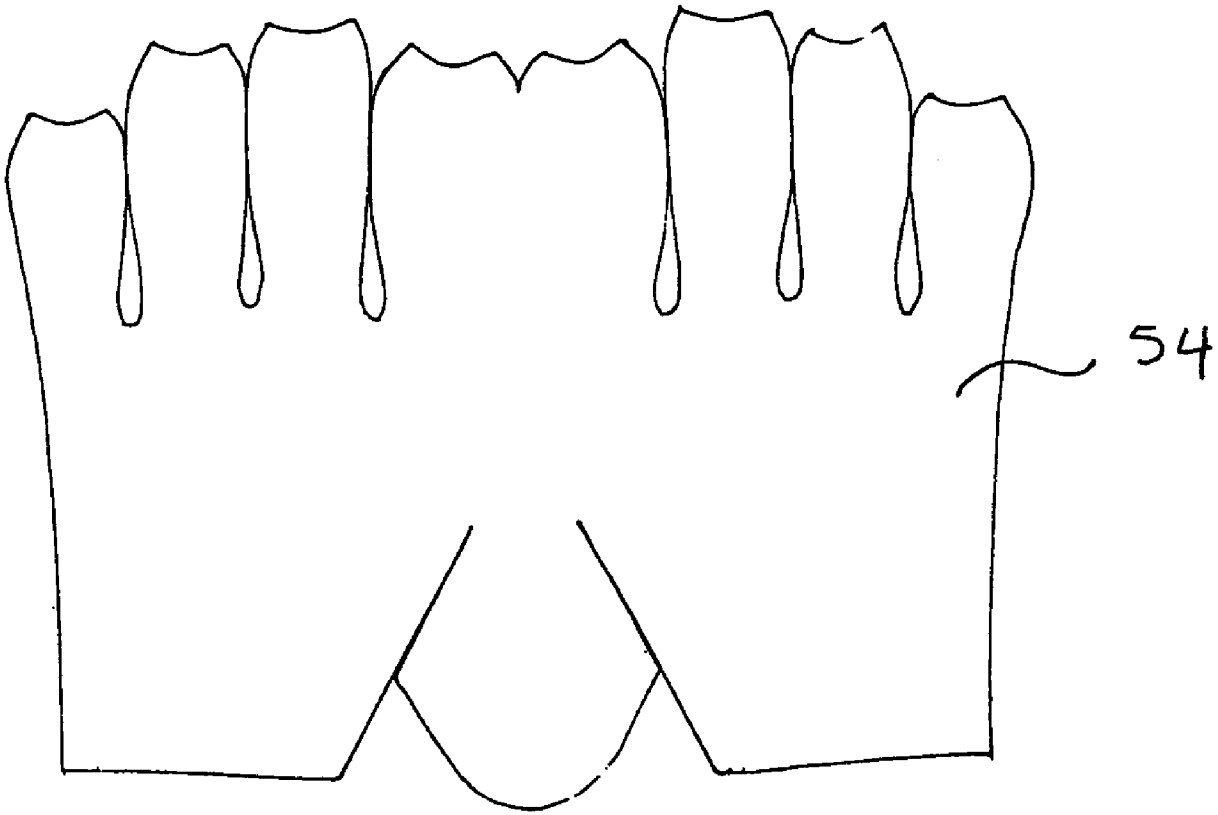
FIG. 18 is a plan view of the liner.

FIG. 18, illustrates the general arrangement of liner 54. When the glove is stitch assembled, it is performed with the patterned pieces inside out. Wherever there is a stitch line, there is an excess of material that will reside in the glove interior. Liner 54 is stitched to this excess of material such that when the glove is turned inside out after stitch assembly, liner 54 will reside in the glove interior. The liner is generally of a thin cotton, nylon or poly cotton material to wick sweat and moisture off the hands of the wearer. It also has a generally smooth, soft feel so as to prevent abrasion between the work glove internal surfaces and the hand of the wearer.

Looking at FIGS. 20 to 26 the third alternate embodiment work glove 70 can be seen. This glove, although visually similar to the preferred embodiment work glove is assembled from pieces of different patterns. The distinctive aspect of this glove is the "spacious" feel the fingers experience because of the use of finger sides 74. Finger sides 74 are stitched to palm/finger patterned piece 72 before palm/finger patterned piece 72 is folded over onto itself and stitched together. Thumb 76 is assembled from third alternate embodiment glove thumb back 78, third alternate embodiment glove thumb side 80, third alternate embodiment glove thread saver 82, and inner thumb flap 73 in the same manner that their corresponding patterned pieces are used to assemble the preferred embodiment work glove 1. Similarly, third alternate embodiment work glove cuff 84 is attached to the glove.

Figure 36:
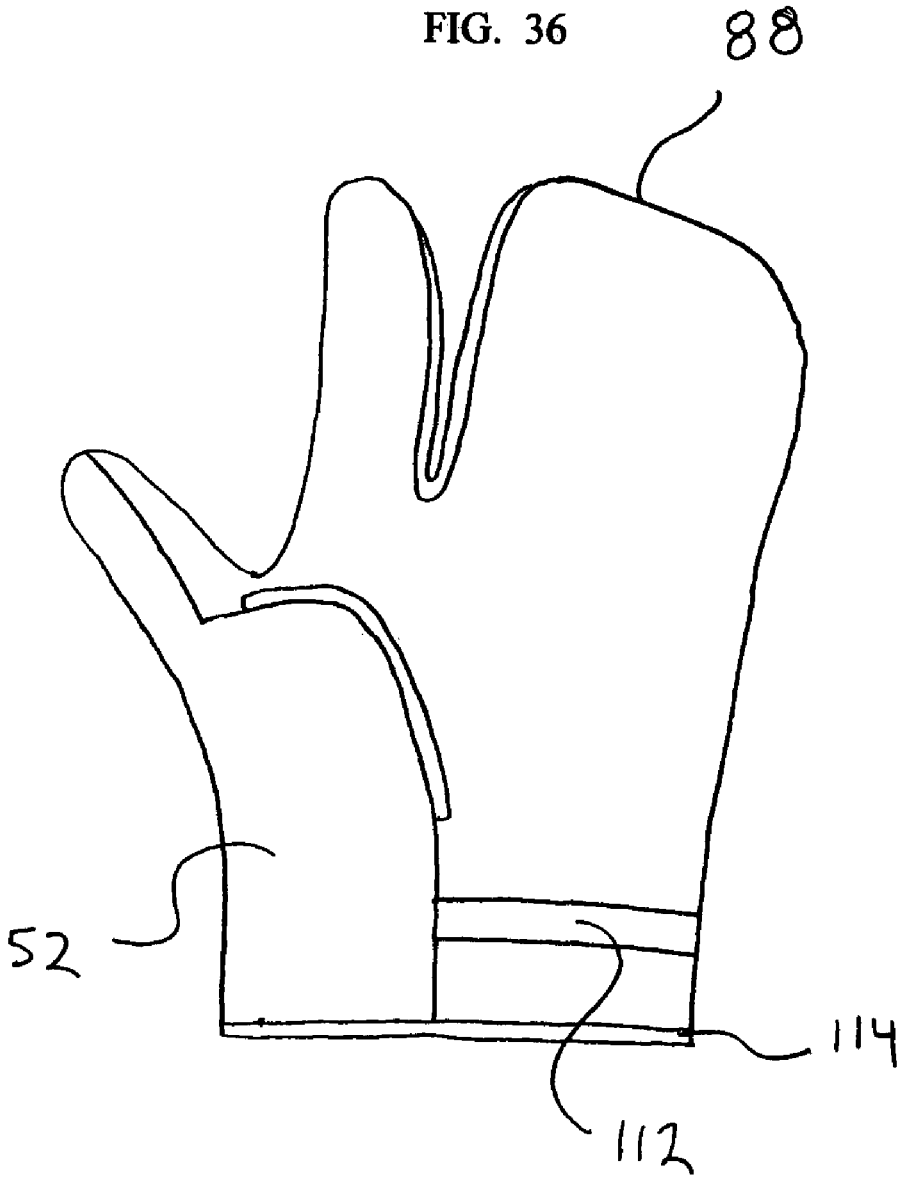
FIG. 36 is a plan view of the second embodiment single finger two sided work mitt with the thumb piece for the second alternate embodiment work glove.

Looking at FIGS. 27 to 36 one can best understand the differences between single finger two sided work mitt 86 (FIGS. 27 to 30) and the second embodiment single finger work mitt 88 (FIG. 36). Both of these mitts utilize many of the features discussed previously with respect to the preferred embodiment work glove 1 and the third alternate embodiment work glove 70. FIG. 27 illustrates a plan view of a first side of single finger two sided work mitt 86. Mitt finger side 90 is stitched to mitt central patterned piece 92 between first side palm section 94 and second side palm section 98 as well as first side index finger section 96 and second side index finger section 100. The inclusion of a finger side again accomplishes the "spacious" feel of the glove. Mitt thumb back 102 is stitched to mitt thumb inner flap 104 and mitt thumb side flaps 106. There are two identical mitt thumb side flaps 106. They are attached as mirror images onto opposite sides of mitt thumb back 102. Mitt thread saver strips 108 are sewn between mitt thumb side flaps 106 and mitt central patterned piece 92. FIG. 28 illustrates a second side of single finger two sided work mitt 86. Seam 110 which is accomplished when mitt central patterned piece 92 is folded over onto itself for assembly, can be seen. Elastic straps 112 are sewn between mitt thumb back 102 and seam 110 on both the first and second sides of single finger two sided work mitt 86. Elastic strap 112 serves to "bunch" the assembled mitt patterned pieces in the vicinity of the wrist. This allows better retention of the mitt on the hand. Hem strip 114 encircles the entire assembly about the hand opening (not illustrated).

Referring to FIG. 36 of second embodiment single finger work mitt 88, it can be seen that this second embodiment utilizes full thumb piece 52 (FIG. 16) of second alternate embodiment work glove 48 in place of mitt thumb side flaps 106 and Mitt thumb back 102. In this configuration elastic straps 112 are sewn between mitt thumb side flaps 106 and seam 110 on both the first and second sides of single finger two sided work mitt 86.

What is claimed is:

1. A two sided glove comprising:

a palm piece containing an inner thumb piece and adapted to form a first finger pocket and a fourth finger pocket;

an outer thumb piece stitched to said inner thumb piece;

two side thumb pieces stitched to said inner thumb piece and said outer thumb piece; and a middle fingers piece stitched to said palm piece and adapted to form a second finger pocket and a third finger pocket;

a short narrow strip of material sandwiched between said middle fingers piece and said palm piece by the stitching joining said middle fingers piece and said palm piece; and a long narrow strip of material sandwiched between said thumb side piece and said palm piece by the stitching joining said thumb side piece and said palm piece;

wherein said glove has an outer and an inner surface and said stitching is concealed from said glove's outer surface by virtue of said stitching being performed on said inside surfaces and wherein said short narrow strip and said long narrow strip are adapted to form overhanging thread savers on said outer surface of the glove.

2. The glove of claim 1 further comprising a wear guard piece of material sewn onto said palm piece wherein said wear guard is patterned to conform to areas of said glove subject to excessive wear.

* * * * *